US007527580B2

(12) United States Patent
Freisinger

(10) Patent No.: US 7,527,580 B2
(45) Date of Patent: May 5, 2009

(54) METHOD OF SHUTTING DOWN AN INTERNAL COMBUSTION ENGINE

(75) Inventor: Normann Freisinger, Lorch (DE)

(73) Assignee: Daimler AG, Stuttgart (DE)

( * ) Notice: Subject to any disclaimer, the term of this patent is extended or adjusted under 35 U.S.C. 154(b) by 122 days.

(21) Appl. No.: 11/274,789

(22) Filed: Nov. 15, 2005

(65) Prior Publication Data

US 2006/0065223 A1 Mar. 30, 2006

Related U.S. Application Data

(63) Continuation-in-part of application No. PCT/EP2004/003523, filed on Apr. 2, 2004.

(30) Foreign Application Priority Data

May 17, 2003 (DE) ..... 103 22 305

(51) Int. Cl.
*F02N 17/00* (2006.01)

(52) U.S. Cl. ..... 477/199; 123/179.4; 123/198 C

(58) Field of Classification Search ..... 477/99, 477/100; 123/179.4, 41 E, 179.5, 179.18, 123/366; 701/101, 112
See application file for complete search history.

(56) References Cited

U.S. PATENT DOCUMENTS

| | | | | |
|---|---|---|---|---|
| 4,510,396 | A | 4/1985 | Uchida et al. | |
| 6,283,079 | B1 * | 9/2001 | Cumming et al. | 123/192.1 |
| 6,453,864 | B1 * | 9/2002 | Downs et al. | 123/179.3 |
| 6,971,357 | B2 * | 12/2005 | Grieser et al. | 123/179.18 |
| 7,011,063 | B2 * | 3/2006 | Condemine et al. | 123/179.4 |
| 7,082,899 | B2 * | 8/2006 | Hanson et al. | 123/41 E |
| 7,142,973 | B2 * | 11/2006 | Ando | 701/112 |
| 7,191,756 | B2 * | 3/2007 | Phlips et al. | 123/366 |
| 2004/0123831 | A1 * | 7/2004 | Grieser et al. | 123/198 DB |

FOREIGN PATENT DOCUMENTS

| | | | |
|---|---|---|---|
| DE | 197 35 455 | | 11/1998 |
| DE | 198 58 992 | | 10/1999 |
| DE | 198 35 045 | | 4/2000 |
| DE | 199 49 931 | | 4/2001 |
| DE | 199 60 984 | | 6/2001 |
| DE | 100 30 001 | | 7/2001 |
| DE | 100 50 170 | | 4/2002 |
| DE | 102 10 246 | | 9/2002 |
| EP | 1 113 169 | | 7/2001 |
| JP | 11107793 | A * | 4/1999 |
| JP | 11107823 | A * | 4/1999 |
| JP | 2001159339 | A | 6/2001 |
| JP | 2002188471 | A | 7/2002 |
| WO | WO 03012273 | * | 2/2003 |

* cited by examiner

*Primary Examiner*—Tisha D Lewis
(74) *Attorney, Agent, or Firm*—Klaus J. Bach

(57) ABSTRACT

In a method of shutting down an internal combustion engine, the shutdown of the internal combustion engine is executed upon initiation of the shut-down procedure starting from a defined operating condition which is selected in such a way that a desired rest position of the crankshaft is achieved from which the engine can be rapidly restarted.

9 Claims, No Drawings

METHOD OF SHUTTING DOWN AN INTERNAL COMBUSTION ENGINE

This is a Continuation-In-Part Application of International Application PCT/EP2004/003523 filed Apr. 2, 2004 and claiming the priority of German application 103 22 305.3 filed May 17, 2003.

BACKGROUND OF THE INVENTION

The invention relates to a method of shutting down an internal combustion engine, particularly a motor vehicle internal combustion engine.

The shut down of an internal combustion engine of a motor vehicle is usually initiated by the driver using the ignition key. Turning the ignition key generally cuts off the fuel supply, that is, the injection valves or injectors are de-energized. In the case of stop-start operation the shut down of the internal combustion engine is initiated by the engine management system, once certain conditions such as a zero vehicle speed and an actuation of the brake of the motor vehicle are fulfilled.

When an internal combustion engine is switched on—by the driver turning the ignition key or by the engine management system in stop-start operation of the internal combustion engine—with electronically controlled ignition and/or injection, there is the problem that the actual position of the internal combustion engine, that is to say the angular position of the crankshaft and the camshaft and hence the cylinder position are initially unknown. Only once the shafts of the internal combustion engine are turning do the assigned sensors deliver analyzable output signals, from which it is possible to determine the instantaneous position of the crankshaft and the camshaft. Only when certain engine-specific conditions are fulfilled and the reference mark on the crankshaft sensor wheel is recognized can synchronization take place, in which the correct angular position of the crankshaft and the camshaft is detected and in which the correct cylinder positions are therefore also known.

When starting an internal combustion engine from different positions of the crankshaft the starting time can vary considerably. There are especially unfavorable and especially favorable positions. In the most unfavorable case, for example, a four-cylinder, four-stroke engine needs approximately 180° more rotation of the crankshaft for starting of the internal combustion engine than in the most favorable position. The instant start up of a spark ignition engine is only possible if the crankshaft happens by chance to have attained the necessary starting position for instant starting.

Various approaches to a solution of this problem are disclosed by the state of the art.

Thus DE 198 58 992 A1, for example, describes a starting/drive unit for an internal combustion engine of a motor vehicle, in which the actual process of starting the internal combustion engine is preceded by a starting clarification phase, in which the starting conditions are detected with the clutch engaged and a decision is made with regard to the ensuing operating phase. This starting clarification phase is intended to permit starting of an internal combustion engine without the usual starter.

A further approach to solving the problem outlined above consists in actively positioning the crankshaft upon shut down of the internal combustion engine of a motor vehicle. DE 198 35 045 C2, DE 199 36 885 C2 and DE 199 60 984 A1, for example, disclose various methods for actively controlling the process of shutting down an internal combustion engine, in which the crankshaft is stopped in a defined angular position, which corresponds to the most favorable starting position of the internal combustion engine. Stopping the crankshaft in a specific angular position is achieved, according to DE 198 35 045 C2 for example, by means of a braking system, in the case of DE 199 36 885 C2 by means of an electric motor for generating a brake torque, and in the case of DE 199 60 984 A1 by an exhaust valve control system.

Alternatively it is also possible to move the crankshaft into a desired angular position during or after the shut down of the internal combustion engine. DE 100 30 001 A1 discloses a method for the controlled shutting down of an internal combustion engine, in which the crankshaft is moved into the desired angular position after completion of the shutdown process; DE 100 50 170 A1 describes a method in which means of braking or driving bring the crankshaft into a predefined rest position during the process of shutting down the internal combustion engine.

Such methods in which the crankshaft is actively positioned during the process of shutting down the internal combustion engine are only feasible, however, in connection with some but not all starting systems.

For the sake of completeness, reference is also be made to DE 197 35 455 C1, which discloses a method which actively intervenes in the process of shutting down an internal combustion engine in order to reduce exhaust emissions. However, this active intervention in the shutting down process does not have any direct influence on the rest position of the crankshaft.

Based on the aforementioned state of the art, it is the object of the present invention to provide a method of shutting down an internal combustion engine in such a way that the engine starting time during the subsequent starting process of the internal combustion engine is significantly reduced regardless of the starting system.

SUMMARY OF THE INVENTION

In a method of shutting down an internal combustion engine, the shutdown of the internal combustion engine is executed upon initiation of the shutting down procedure starting from a defined operating condition which is selected in such a way that a desired rest position of the crankshaft is achieved from which the engine can be rapidly restarted.

In a known method for shutting down the internal combustion engine, the actual process of switching off the internal combustion engine is therefore delayed after the time of initiation of the shut-down process, until a defined operating condition of the internal combustion engine is attained. If the internal combustion engine is switched off from this defined operating condition, no active intervention in the shut-down process is then necessary; the crankshaft automatically reaches a desired rest position, which corresponds to the most favorable starting position for a subsequent startup of the internal combustion engine.

The defined operating condition of the internal combustion engine may be a specific number of revolutions of the internal combustion engine, a specific throttle valve position of the internal combustion engine, a specific load of the alternator and/or auxiliaries, a defined final injection and combustion in a specific cylinder of the internal combustion engine, or a combination of these parameters. The defined operating condition for shutting down the internal combustion engine varies according to the type and design of the internal combustion engine, but can be readily determined.

In a further development of the invention the defined operating condition for shutting down the internal combustion engine is furthermore learned by the engine control system and is optimized during the operation of the internal combustion engine.

In a particular embodiment of the invention the rest position of the crankshaft may in addition be controlled by actively influencing the shutdown process. This is done, for example, by adjusting the throttle valve position during the process of shutting down, by adjusting the load in the belt drive during the process of shutting down (for example, power steering pump, air conditioning system, etc.), by active braking of the internal combustion engine with the clutch of a transmission on the engine output side and then immediately disengaging the clutch and the like.

It is furthermore advantageous to activate the brakes of the motor vehicle during the process of shutting down the internal combustion engine, in order to prevent any movement of the motor vehicles and any unwanted change of the angular position of the crankshaft of the internal combustion engine caused thereby.

With the method of shutting down an internal combustion engine as described above and defined in the claims attached it is readily possible, irrespective of the starting system of the internal combustion engine and without active intervention in the positioning of the crankshaft of the internal combustion engine, to obtain the most favorable rest position of the crankshaft for a subsequent startup of the internal combustion engine. Instead of undefined conditions when shutting down the internal combustion engine, which result in a fundamentally random rest position of the crankshaft, in the method according to the invention the internal combustion engine is shut down from a defined operating point, which results in a specific rest position of the crankshaft. For this purpose it is only necessary for the shutdown behavior of the internal combustion engine to be known, which in the ongoing operation of the internal combustion engine can be continuously learned for optimization of the method.

What is claimed is:

1. A method of shutting down an internal combustion engine, comprising the steps of bringing the engine to a predetermined operating state which is defined by at least one of a particular throttle valve position, a particular load on the alternator and other auxiliary components, a defined last injection or combustion in a particular cylinder of the internal combustion engine, and initiating the process of switching off the internal combustion engine and executing the shutdown from the predetermined operating state selected in such a way that a desired rest position of the crankshaft is achieved without interventive action during engine coast-down.

2. The method according to claim 1, wherein the engine shut-down is performed with the engine operating at a specific throttle valve position.

3. The method according to claim 1, wherein the engine shut-down is performed with a specific load of at least one of the alternator and the auxiliaries.

4. The method according to claim 1, wherein the engine shut down is initiated with a defined final injection and combustion in a specific cylinder of the internal combustion engine.

5. The method according to claim 1, wherein the most favorable Conditions for shutting down the internal combustion engine are learned and optimized based on previous shut-downs.

6. The method according to claim 1, wherein the rest position of the crankshaft is influenced by adjusting the throttle valve position during the shut-down process.

7. The method according to claim 1, wherein the rest position of the crankshaft is influenced by a setting of the load in a belt drive during the shut-down process.

8. The method according to claim 1, wherein the rest position of the crankshaft is influenced by active braking of the internal combustion engine using a clutch on the engine output side.

9. The method according to claim 1, wherein vehicle brakes of the motor vehicle are activated during the process of shutting down the internal combustion engine, in order to prevent any movement of the motor vehicle.

* * * * *